US007170822B2

(12) United States Patent
Peck

(10) Patent No.: US 7,170,822 B2
(45) Date of Patent: Jan. 30, 2007

(54) LAMINATED PIEZOELECTRIC TRANSDUCER AND METHOD OF MANUFACTURING THE SAME

(75) Inventor: Jerry Peck, Mission Viejo, CA (US)

(73) Assignee: Undersea Systems International, Inc., Costa Mesa, CA (US)

( * ) Notice: Subject to any disclaimer, the term of this patent is extended or adjusted under 35 U.S.C. 154(b) by 122 days.

(21) Appl. No.: 10/961,303

(22) Filed: Oct. 7, 2004

(65) Prior Publication Data

US 2006/0077761 A1 Apr. 13, 2006

(51) Int. Cl.
*H04R 17/00* (2006.01)

(52) U.S. Cl. ..... 367/165

(58) Field of Classification Search ..... 367/165, 367/173, 167, 172

See application file for complete search history.

(56) References Cited

U.S. PATENT DOCUMENTS

| | | | | |
|---|---|---|---|---|
| 2,906,993 | A * | 9/1959 | Steinberger | 367/167 |
| 3,670,299 | A * | 6/1972 | Kahn | 367/175 |
| 3,909,529 | A | 9/1975 | Morrow et al. | |
| 3,993,973 | A * | 11/1976 | Hutchins et al. | 367/172 |
| 4,454,927 | A | 6/1984 | Seebinger | |
| 5,117,403 | A | 5/1992 | Eberl et al. | |
| 5,812,496 | A * | 9/1998 | Peck | 367/174 |
| 6,545,948 | B1 | 4/2003 | Jiang | |
| 6,693,849 | B1 | 2/2004 | Eberl et al. | |
| 2003/0123692 | A1 | 7/2003 | Ueki | |

FOREIGN PATENT DOCUMENTS

| | | |
|---|---|---|
| GB | 1 546 521 | 5/1979 |
| GB | 0 317 167 | 5/1989 |
| JP | 0 669 169 A | 8/1995 |
| WO | WO 95/21512 | 8/1995 |
| WO | WO 2005/112503 | 11/2005 |

* cited by examiner

*Primary Examiner*—Dan Pihulic
(74) *Attorney, Agent, or Firm*—Myers Dawes Andras & Sherman LLP

(57) ABSTRACT

The invention is illustrated as an underwater acoustic transducer comprising an active acoustic element for transducing sound and electrical signals; a front and rear housing element disposed on each side of the active acoustic element to define a corresponding front and rear acoustic chamber on each side of the active acoustic element; and a rear cover disposed on the rear housing element to provide tuning of the corresponding rear acoustic chamber. In the method of manufacturing the an underwater acoustic transducer, the method includes the step of selecting a port diameter and/or thickness of the front and rear housing elements according to an empirically tuned acoustic performance of the underwater acoustic transducer in combination with the facemask, helmet or headgear in or on which the underwater acoustic transducer is mounted.

19 Claims, 2 Drawing Sheets

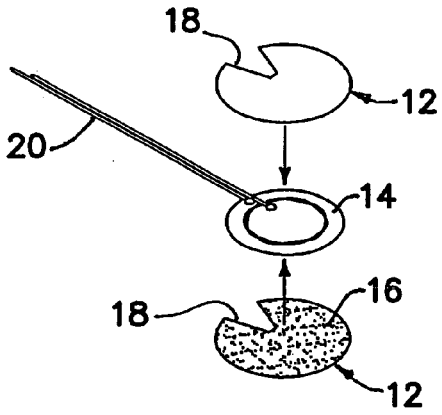
FIG. 1
FIG. 2
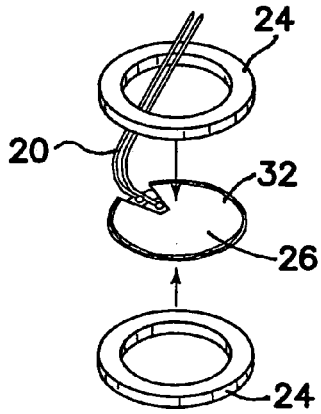
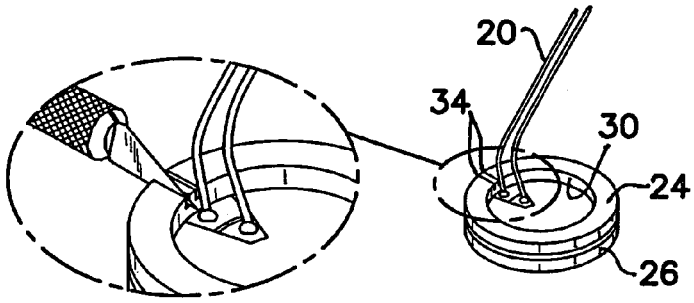
FIG. 3
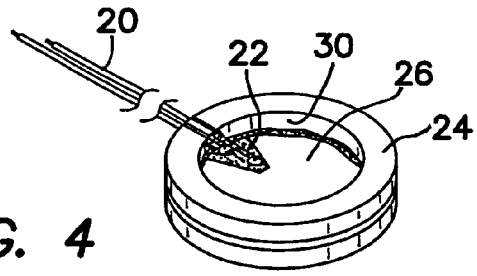
FIG. 4

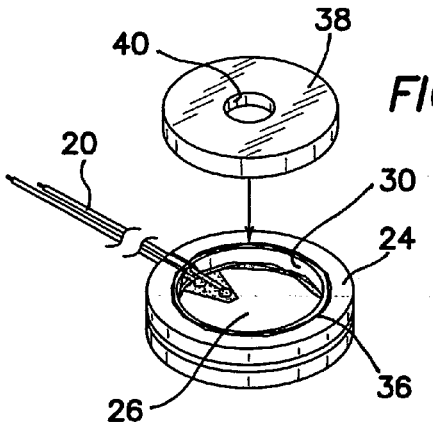
FIG. 5
FIG. 6
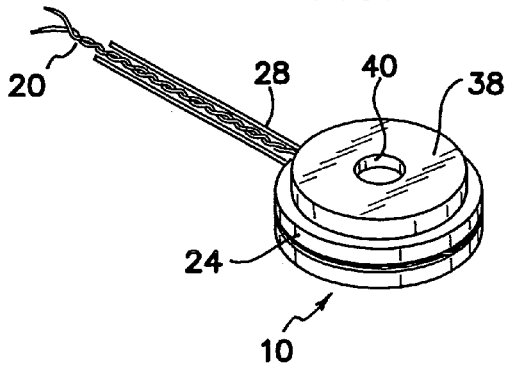
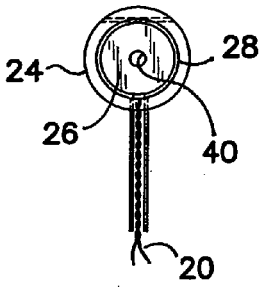
FIG. 7
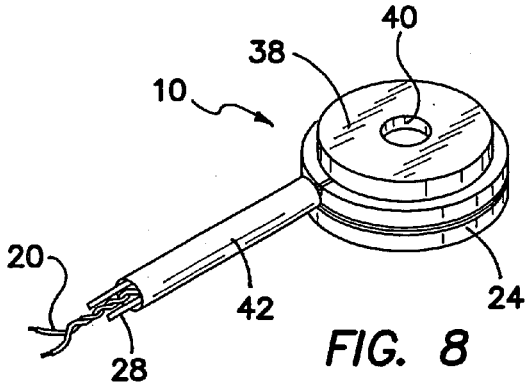
FIG. 8

LAMINATED PIEZOELECTRIC TRANSDUCER AND METHOD OF MANUFACTURING THE SAME

BACKGROUND OF THE INVENTION

1. Field of the Invention

The invention relates to the field of underwater acoustic transducers for divers and in particular to a structure in which and a method by which such underwater acoustic transducers are tuned and manufactured.

2. Description of the Prior Art

Prior art, underwater acoustic transducers are typically encapsulated using potting compounds like silicone resin or urethane. This requires special potting equipment and facilities. Other prior art diver's microphones use bladders filled with air to cover the microphone. The bladder collapses with depth, pressure compensating the microphone, but eventually stops compensation because the air in the bladder is compressed to a volume smaller than the microphone. When the air inside the bladder is compressed to this point, the microphone ceases to operate.

Further, prior art underwater acoustic transducers, being potted or fixed in design with an air bladder, have acoustical performances which are fixed by their designs and there is no ready means of tuning them to the specific acoustic characteristics of the facemask, helmet or other headgear with which they are combined and which can material alter their acoustic performance.

What is needed is some kind of design for an underwater acoustic transducer which is easy and inexpensive to manufacture, but which has no depth limitations on its operation and which can be tuned to optimal performance in whatever facemask, helmet or other headgear with which it is combined

BRIEF SUMMARY OF THE INVENTION

The invention is illustrated as an underwater acoustic transducer comprising an active acoustic element for transducing sound and electrical signals; a front and rear housing element disposed on each side of the active acoustic element to define a corresponding front and rear acoustic chamber on each side of the active acoustic element; and a rear cover disposed on the rear housing element to provide tuning of the corresponding rear acoustic chamber.

The active acoustic element comprises an electro-acoustic transducer laminated between to opposing waterproof layers, where the opposing waterproof layers comprise Lexan® or polycarbonate resin thermoplastic layers with an adhesive side in contact with the electro-acoustic transducer. The electro-acoustic transducer comprises a piezoelectric element.

The front and rear housing elements each comprise an elastomeric washer defining an inner port. The rear cover comprises an elastomeric washer defining an inner port.

The underwater acoustic transducer further comprises a stiffener disposed around the housing element and extending therefrom to permit free standing position of the acoustic transducer, which stiffener is a wire which encircles the front and rear housing elements and radially extends therefrom.

The rear cover has a port defined therethrough providing communication of external pressure to the active acoustic element. The front and rear housing elements have corresponding ports defined therethrough providing communication of external pressure to the active acoustic element.

Thus, it can be understood that the underwater acoustic transducer comprises a laminated waterproof and sealed active acoustic element for transducing sound and electrical signals; a front and rear housing element disposed on each side of the active acoustic element to define a corresponding front and rear acoustic chamber on each side of the active acoustic element, each housing element defining a corresponding port therethrough of a predetermined diameter and thickness to provide tuning of the corresponding acoustic chamber and to provide free flooding acoustic chambers; and a rear cover disposed on the rear housing element and defining a corresponding port therethrough of a predetermined diameter and thickness to provide further tuning of the corresponding rear acoustic chamber while maintaining the free flooding characteristic of the rear acoustic chamber.

The invention is also characterized as a method of constructing an underwater acoustic transducer comprising the steps of laminating an active acoustic element for transducing sound and electrical signals between two waterproof layers, disposing a front and rear housing element on each side of the active acoustic element to define a corresponding front and rear tuned acoustic chamber on each side of the active acoustic element, and disposing a rear cover on the rear housing element to provide further tuning of the corresponding rear acoustic chamber.

The step of laminating the active acoustic element comprises adhering the waterproof layers with an adhesive side in contact with the electro-acoustic transducer.

The step of disposing the front and rear housing element on each side of the active acoustic element comprises affixing an elastomeric washer defining an inner port on each side of the active acoustic element to provide free flooding acoustic chambers.

The step of disposing a rear cover on the rear housing element comprises affixing an elastomeric washer defining an inner port on the rear housing element to further tune an rear acoustic chamber without interfering with the free flooding characteristic of the rear acoustic chamber.

Connection wires are coupled to the active acoustic element and the step of disposing the front and rear housing elements on each side of the active acoustic element comprises sealing the connection wires on the active acoustic element and within the front and rear housing elements.

The method further comprises the step of disposing a stiffener around the housing elements and extending therefrom to permit free standing position of the acoustic transducer. The stiffener is disposed around the housing elements by encircling the front and rear housing elements with a wire which radially extends therefrom.

The method further comprises the step of mounting the underwater acoustic transducer within or on a facemask, helmet or headgear by attaching the stiffener to the facemask, helmet or headgear and bending the stiffener to operatively position the acoustic transducer.

The method comprises selecting a port diameter and/or thickness of the front and rear housing elements according to an empirically tuned acoustic performance of the underwater acoustic transducer in combination with the facemask, helmet or headgear in or on which the underwater acoustic transducer is mounted.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 1 is an exploded perspective view of the supermic assembly of the invention.

FIG. 2 is an exploded perspective view of the supermic assembly of FIG. 1 being assembled with the rubber washers used for acoustic tuning and mounting.

FIG. 3 is an assembled perspective view of the supermic assembly and rubber washers of FIG. 2 showing modification of the washers to accommodate the wires to the supermic assembly.

FIG. 4 is an assembled perspective view of the supermic assembly and rubber washers of FIG. 3 showing embedding of the wires to the supermic assembly and potting of their connection to the active element.

FIG. 5 is an exploded perspective view of the supermic assembly and rubber washers of FIG. 4 showing capping of the assembly with a disk cover.

FIG. 6 is a perspective view of the rear side of the covered supermic assembly and rubber washers of FIG. 5 showing reinforcement of the assembly with nickel wire.

FIG. 7 is a top plan view of rear side the covered supermic assembly of FIG. 6.

FIG. 8 is a perspective view of the rear side of the completely assembled supermic assembly with the front side of the completely assembled supermic assembly being the opposing side and positioned downwardly out of view.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

The invention is a transducer assembly 10 designed to be easily manufactured and to be water- and pressure-proof. This transducer assembly 10 can be used as an acoustic transducer for use as a diver's microphone, hydrophone or underwater speaker. The transducer assembly 10 is easily manufactured by using laminated waterproof disks 12 as illustrated by the sequence of drawings of FIGS. 1–8. As shown in the exploded view of FIG. 1 the active piezoelectric element 14 is sandwiched or laminated between two 0.005-inch Lexan® disks 12 having a waterproof self-adhering adhesive layer 16 on one side. Other plastics or materials of similar properties could be substitute for Lexan®, which is a trademark of General Electric Co. In addition, other types of active elements may be substituted for piezoelectric element 14. The details of the construction or nature of element 14 are not material to the invention. Any acoustic-to-electric signal transducer now known or later devised may be employed. Further, while the invention is described below as a microphone, it is to be expressly understood that the reverse may be true, in other words, piezoelectric element 14 could be arranged and configured according to well known principles to operate as an earphone or speaker, which is acoustically coupled to either air or water.

Notches 18 on the periphery of the disks 12 provide access or space for connecting wires 20 which are connected to active element 14. These notches 18 are subsequently sealed using a suitable urethane adhesive 22 as depicted in the perspective view of FIG. 4.

The assembly of elements 12, 14, 16, 20, collectively denoted in the perspective view of FIG. 2 by reference character 26 and termed supermic label 26, is mounted in a rubber housing 24 comprised of rings resembling rubber washers in form. Two of the washers 24 are attached to the supermic label 26 using a suitable adhesive. For example, a general-purpose urethane such as Kalex Tuff adhesive, which is a trademark of Hardman Inc. of Belleville, N.J. that exhibits excellent bonding to both polychloroprene rubber and Lexan® can be employed. One or more additional washer-like disks (not shown) of any appropriate material, such as rubber, polyurethane, neoprene or the like, can be attached to the front, rear or both sides of washers 24 for acoustic tuning purposes. The additional washers may have variable thicknesses and inner diameters according to the acoustic tuning needed, which is empirically determined for the specific design of the facemask in which assembly 10 is mounted using an acoustic frequency spectrum analyzer. The acoustic characteristics of each facemask design will differ from each other design. Thus, the inner diameter of the two washers 24 may be identical or different depending on tuning as described below. Hereinafter, reference to a single washer 24 will be understood to mean to include one or collectively all of the washers 24 employed. In addition, it must be understood that wherever the term, facemask, is used, diving helmets, facemasks and all other diving headgear are understood to be within the scope of the invention.

A bead 32 of Kalex Tuff or other adhesive is applied to the peripheral edge of supermic label 26 as shown in FIG. 2. Washers 24 are then pressed to the front and back of supermic label 26 with wires 20 lead through the inner diameter of the adjacent washer 24. Two narrow cuts or grooves 34 are cut into the adjacent washer 24 to a depth to allow the full insertion of wires 20 therein as shown in FIG. 3, one wire 20 being placed into one corresponding groove 34. Wires 20 are then laid into grooves 34 and notch 18 and at least the inner end of grooves 34 are potted or sealed with adhesive 22 as shown in FIG. 4.

A bead 36 of adhesive is laid down on the periphery of one of the washers 24, which is defined as the rear washer 24 with the opposing washer 24 being defined as the front washer 24, and a rear rubber washer 38 with an inner diameter through hole or port 40 is laid down on bead 36 as shown in FIG. 5. While a through hole or port 40 is preferred and illustrated, it is also within the scope of the invention that in some applications hole or port 40 may be a blind hole with a thin membranous bottom surface. Rear washer 38 has an outer diameter greater than port 30 defined by the inner diameter of washers 24 and hence provides a perforated cover for one side of transducer assembly 10. The opposing front side of transducer assembly 10 is preferably left open, but in some applications may be provided with a perforated cover or completely covered by a membranous or porous surface as may be desired in the specific application.

Wires 20 are twisted together as a pair to minimize stray pickup and nickel wire 28 or other stiffener is laid parallel to wires 20 and around washers 24 in the interlying space between washers 24, which is defined by providing a slightly larger outer diameter for washers 24 than for supermic label 26. Nickel wire 28 thus forms an enclosing reinforcement completely around supermic label 26 and washers 24 and is led away from assembly 10 parallel to wires 20 for a predetermined length as shown in FIG. 6. The arrangement is also illustrated in the top plan view of FIG. 7. Wires 28 thus allow assembly 10 to be positioned in the facemask by bending wires 28 as needed.

Heat shrink tubing 42 is then telescopically disposed over wires 28 and wires 20 as shown in FIG. 8 and heated air applied to shrink tubing 42 tightly onto wires 20 and 28. Transducer assembly 10 is thus complete and is ready for mounting in a conventional manner in or on a facemask, which is accomplished by attaching wires 28 is a mounting bracket or other mechanical attachment means and bending wires 28 to position the front surface of transducer assembly 10 in a free standing position within the facemask near or just lightly touching the diver's lips. Similarly, when used as an earpiece, wires 28 are mechanically attached to the facemask or its straps, and wires 28 bent to position the front surface of transducer assembly 10 in a position near or just inside the diver's ear.

One novel feature of this transducer assembly 10 is the particular ease by which it can be acoustically tuned. This is an important advantage. For instance, in a diver's full-face mask, there are other acoustic properties that affect the acoustic response of any microphone mounted on or in the mask. By adjusting the port size 30 or inner diameter of washer 24, the resulting installed microphone can be configured to exhibit a response that suppresses the muffled effect that is a result of the mask's acoustic Helmholtz effect. Usually the acoustic Helmholtz effect causes a rising response of the microphone as the frequencies moves toward 0 Hz or DC levels. To counter the acoustic Helmholtz effect, the transducer assembly 10 when used as a microphone is "ported" or constructed with washers 24 of selected thicknesses and inner diameters 30 as shown in FIGS. 1–8 such that its acoustic response is exactly opposite than that of the facemask cavity. Because all facemasks are not the same, there is a need to adjust the microphone acoustic response in a way that suppresses the mask's acoustic peaks and valleys. If a greater rising frequency response in needed, additional porting can be applied to the front of the transducer assembly 10.

Nickel wire 28 is used in transducer assembly 10 as a means of reinforcement and to allow positioning of transducer assembly 10. It is both non-corrosive as well as flexible allowing the user to position the transducer assembly 10 if used as a microphone close to the diver's lips when employed as a microphone or ear(s) when employed as an earpiece.

When used as a microphone, transducer assembly 10 exhibits a high degree of noise cancellation because of its gradient characteristics. The degree of cancellation is controlled by the dimensions of the port 30 defined by the inner diameter of washers 24 applied to the front, rear or both (if used) of supermic label 26. If the acoustic path to supermic label 26 is made to be longer in the back of supermic label 26 than the front, because the rear port 30 has an added length, acoustic energy close the front of supermic label 26 will tend to produce a large electrical signal. However, if this energy comes from a greater distance, then the signal tends to cancel out. This is a conventional method by which noise canceling microphones operate. What is unique in the disclosed embodiment is the ease by which the amount of cancellation as well as acoustic response is controlled via simple rubber ports 30 defined by washers 24. This in turn makes the design a very flexible assembly 10 that can be easily configured to sound best in a wide variety of full-face masks.

It is to be expressly understood as well that the diameter of port 30 of the front and rear washers need not be identical. Typically, the diameter of port 40 is less than that of port 30. Stepped acoustic tuning may be achieved, for example, by providing a series of rear washers 24 with decreasing diameters of port 30. In addition rear or front washers 24 need not be restricted to a cylindrical shape as depicted in FIGS. 1–8, but may instead have a conical inner surface or a surface with another shaped contour chosen according to the desired acoustic performance.

The laminated assembly process eliminates the need to completely encapsulate the front and rear of the element assembly. That in turn saves considerable manufacturing time and expense.

In can now be appreciated that in the prior art, acoustic transducers were encapsulated using potting compounds like silicone resin or urethane. This requires special potting equipment and facilities. In the disclosed design the use of a small amount of urethane to cover the notch area where the wires emerge from the piezoelectric element is preferred, but this requires is a small amount of labor compared to complete encapsulation.

Other prior art diver's microphones use bladders filled with air to cover the microphone. The bladder collapses with depth, pressure compensating the microphone, but eventually stops compensation because the air in the bladder is compressed to a volume smaller than the microphone. When the air inside the bladder is compressed to this point, the microphone ceases to operate.

A unique feature of the transducer assembly 10 of the invention is that it doesn't have any bladders or for that matter any air space whatsoever. Accordingly it can go to the bottom of the deepest ocean and function unaffected by depth and pressure.

Since assembly 10 is a transducer, it will also function as an underwater earphone or speaker if rear porting offers the correct acoustic resistance in water is employed. Current speaker designs use air-backed elements that are subject to pressure effects and therefore have limited depth capability. The free flooding, self-cleaning, tunable and solid design of the invention does away with these problems.

Transducer assembly 10 can be used as both a waterproof and pressure proof microphone. Its simple design provides a simple means to manufacture a variety of divers' microphones and/or earphones. It solves the problems experienced by current designs where air backed or balloon devices are needed for pressure compensation.

Another advantage to this invention is the laminated structure that waterproofs the active piezoelectric element 14 without the need to encapsulate it.

Many alterations and modifications may be made by those having ordinary skill in the art without departing from the spirit and scope of the invention. For example, Instead of washers, the ported washer assembly may be designed as a single molded unit thereby eliminating the need to use a bead of urethane and saving considerable assembly time. If assembled in this way, only a small amount of urethane or suitable resin is needed to seal the electrical connections or any exposed un-insulated wires or connections. A limitation to the molded rubber assembly is that unless additional molded ports are made as part of the design, acoustic tuning will be optimized for a particular mask or helmet.

In addition to the above, instead of using nickel wires, one may design a plastic mounting structure or the like for the purposes of mounting the assembled transducer in a mask or helmet. The groove intended for the nickel wire is used in conjunction with a smaller opening in such a plastic structure whereby the thickness of the plastic comprising the periphery of the circular opening replaces the thickness of the nickel wire and is used to hold the transducer.

Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. An underwater acoustic transducer comprising:

an active acoustic element for transducing sound and electrical signals;

a front and rear housing element disposed on each side of the active acoustic element to define a corresponding front and rear acoustic chamber on each side of the active acoustic element; and a rear cover disposed on the rear housing element to provide tuning of the corresponding rear acoustic chamber, where the active acoustic element comprises an electro-acoustic transducer sealed between two opposing waterproof layers.

2. The underwater acoustic transducer of claim 1 where the opposing waterproof layers comprise polycarbonate resin thermoplastic layers with an adhesive side in contact with the electro-acoustic transducer.

3. The underwater acoustic transducer of claim 1 where the electro-acoustic transducer comprises a piezoelectric element.

4. An underwater acoustic transducer comprising:

an active acoustic element for transducing sound and electrical signals;

a front and rear housing element disposed on each side of the active acoustic element to define a corresponding front and rear acoustic chamber on each side of the active acoustic element; and a rear cover disposed on the rear housing element to provide tuning of the corresponding rear acoustic chamber, where the front and rear housing elements each comprise an elastomeric washer defining an inner port.

5. An underwater acoustic transducer comprising:

an active acoustic element for transducing sound and electrical signals;

a front and rear housing element disposed on each side of the active acoustic element to define a corresponding front and rear acoustic chamber on each side of the active acoustic element; and a rear cover disposed on the rear housing element to provide tuning of the corresponding rear acoustic chamber, where the rear cover comprises an elastomeric washer defining an inner port.

6. The underwater acoustic transducer of claim 4 where the rear cover comprises an elastomeric washer defining an inner port.

7. An underwater acoustic transducer comprising:

an active acoustic element for transducing sound and electrical signals;

a front and rear housing element disposed on each side of the active acoustic element to define a corresponding front and rear acoustic chamber on each side of the active acoustic element;

a rear cover disposed on the rear housing element to provide tuning of the corresponding rear acoustic chamber; and a stiffener disposed around the housing element and extending therefrom to permit free standing position of the acoustic transducer.

8. The underwater acoustic transducer of claim 7 where the stiffener comprises a wire which encircles the front and rear housing elements and radially extends therefrom.

9. An underwater acoustic transducer comprising:

an active acoustic element for transducing sound and electrical signals;

a front and rear housing element disposed on each side of the active acoustic element to define a corresponding front and rear acoustic chamber on each side of the active acoustic element; and a rear cover disposed on the rear housing element to provide tuning of the corresponding rear acoustic chamber;

where the rear cover has a port defined therethrough providing communication of external pressure to the active acoustic element and where the front and rear housing elements have corresponding ports defined therethrough providing communication of external pressure to the active acoustic element.

10. An underwater acoustic transducer comprising:

a laminated waterproof and sealed active acoustic element for transducing sound and electrical signals;

a front and rear housing element disposed on each side of the active acoustic element to define a corresponding front and rear acoustic chamber on each side of the active acoustic element, each housing element defining a corresponding port therethrough of a predetermined diameter and thickness to provide tuning of the corresponding acoustic chamber and to provide free flooding acoustic chambers; and a rear cover disposed on the rear housing element and defining a corresponding port therethrough of a predetermined diameter and thickness to provide further tuning of the corresponding rear acoustic chamber while maintaining the free flooding characteristic of the rear acoustic chamber.

11. A method of constructing an underwater acoustic transducer comprising:

laminating an active acoustic element for transducing sound and electrical signals between two waterproof layers;

disposing a front and rear housing element on each side of the active acoustic element to define a corresponding front and rear tuned acoustic chamber on each side of the active acoustic element; and disposing a rear cover on the rear housing element to provide further tuning of the corresponding rear acoustic chamber.

12. The method of claim 11 where laminating the active acoustic element comprises adhering the waterproof layers with an adhesive side in contact with the electro-acoustic transducer.

13. The method of claim 11 where disposing the front and rear housing element on each side of the active acoustic element comprises affixing an elastomeric washer defining an inner port on each side of the active acoustic element to provide free flooding acoustic chambers.

14. The method of claim 11 where disposing a rear cover on the rear housing element comprises affixing an elastomeric washer defining an inner port on the rear housing element to further tune an rear acoustic chamber without interfering with the free flooding characteristic of the rear acoustic chamber.

15. The method of claim 11 where connection wires are coupled to the active acoustic element and where disposing the front and rear housing elements on each side of the active acoustic element comprises sealing the connection wires on the active acoustic element and within the front and rear housing elements.

16. The method of claim 11 further comprising disposing a stiffener around the housing elements and extending therefrom to permit free standing position of the acoustic transducer.

17. The method of claim 11 further comprising disposing a stiffener around the housing elements to encircle the front and rear housing elements with a wire which radially extends therefrom.

18. The method of claim 11 further comprising mounting the underwater acoustic transducer within or on a facemask by attaching a stiffener to the facemask and bending the stiffener to operatively position the acoustic transducer.

19. The method of claim 11 further comprising mounting the underwater acoustic transducer in or on a facemask and where disposing the front and rear housing elements and disposing the rear cover on the rear housing element comprises selecting a port diameter and/or thickness of the front and rear housing elements according to an empirically tuned acoustic performance of the underwater acoustic transducer in combination with the facemask in or on which the underwater acoustic transducer is mounted.

* * * * *